US009296585B2

(12) United States Patent
Yamada

(10) Patent No.: US 9,296,585 B2
(45) Date of Patent: Mar. 29, 2016

(54) SHEET CONVEYING APPARATUS, DRIVE TRANSMISSION APPARATUS AND IMAGE FORMING APPARATUS

(71) Applicant: CANON KABUSHIKI KAISHA, Tokyo (JP)

(72) Inventor: Koichi Yamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/510,462

(22) Filed: Oct. 9, 2014

(65) Prior Publication Data

US 2015/0108715 A1 Apr. 23, 2015

(30) Foreign Application Priority Data

Oct. 18, 2013 (JP) ..... 2013-217105

(51) Int. Cl.

| | |
|---|---|
| ***B65H 29/58*** | (2006.01) |
| ***B65H 29/60*** | (2006.01) |
| ***G03G 15/00*** | (2006.01) |
| ***G03G 21/16*** | (2006.01) |
| ***B65H 85/00*** | (2006.01) |
| ***B65H 5/26*** | (2006.01) |
| *G03G 15/23* | (2006.01) |

(52) U.S. Cl.

CPC ..... *B65H 29/58* (2013.01); *B65H 5/26* (2013.01); *B65H 29/60* (2013.01); *B65H 85/00* (2013.01); *G03G 15/6529* (2013.01); *G03G 21/1647* (2013.01); *B65H 2301/3332* (2013.01); *B65H 2301/33312* (2013.01); *B65H 2403/481* (2013.01); *G03G 15/234* (2013.01); *G03G 2221/1657* (2013.01); *Y10T 74/18272* (2015.01)

(58) Field of Classification Search

CPC ..... B65H 29/58; B65H 29/60; B65H 85/00; B65H 2403/481; B65H 2301/33312; B65H 2301/3332

See application file for complete search history.

(56) References Cited

U.S. PATENT DOCUMENTS

| | | | | |
|---|---|---|---|---|
| 4,000,942 | A | 1/1977 | Ito et al. | |
| 8,613,445 | B2 * | 12/2013 | Nishii et al. | 271/291 |
| 8,646,776 | B2 | 2/2014 | Agata et al. | |

(Continued)

FOREIGN PATENT DOCUMENTS

| | | | |
|---|---|---|---|
| JP | 2006-056627 | A | 3/2006 |
| JP | 2007022763 | A * | 2/2007 |

(Continued)

*Primary Examiner* — Luis A Gonzalez

(74) *Attorney, Agent, or Firm* — Fitzpatrick, Cella, Harper & Scinto

(57) ABSTRACT

A sheet conveying apparatus includes a conveying member conveying and rotating a sheet, a moving member configured to be movable between a first guiding position and a second guiding position, a first abutting portion configured to stop the moving member at the first guiding position, a second abutting portion configured to stop the moving member at the second guiding position, and a planetary gear mechanism. The planetary gear mechanism includes a first rotating element configured to rotate in a first direction and a second direction which is opposite to the first direction, a second rotating element configured to rotate the conveying member by drivenly rotating with the first rotating element, and a third rotating element configured to move the moving member from the second guiding position to the first guiding position by drivenly rotating with the first rotating element rotating in the first direction, and move the moving member from the first guiding position to the second guiding position by drivenly rotating with the first rotating element rotating in the second direction.

19 Claims, 15 Drawing Sheets

(56) References Cited

U.S. PATENT DOCUMENTS

| | | | | |
|---|---|---|---|---|
| 8,666,297 | B2 * | 3/2014 | Honda et al. | 399/405 |
| 2013/0051884 | A1 | 2/2013 | Yamada | |
| 2013/0156479 | A1 * | 6/2013 | Nara et al. | 399/401 |

FOREIGN PATENT DOCUMENTS

| | | | | |
|---|---|---|---|---|
| JP | 2007-076881 | A | | 3/2007 |
| JP | 2012140201 | A | * | 7/2012 |

* cited by examiner

SHEET CONVEYING APPARATUS, DRIVE TRANSMISSION APPARATUS AND IMAGE FORMING APPARATUS

BACKGROUND OF THE INVENTION

1. Field of the Invention

This disclosure relates to a sheet conveying apparatus having a moving member capable of guiding a sheet, a drive transmission apparatus and an image forming apparatus.

2. Description of the Related Art

In general, in an image forming apparatus configured to form images on both sides of a sheet, when image formation on a first side is terminated, the sheet is switched back and is conveyed to a duplex conveying path for being re-conveyed to the image forming portion. At this time, the sheet is reliably conveyed to the duplex conveying path by using a moving member configured to be capable of switching a conveyance route of the sheet. Recently, simplification of the image forming apparatus is desired for downsizing and power saving of the image forming apparatus.

In contrast, in an image forming apparatus disclosed in Japanese Patent Laid-Open No. 2007-76881, simplification of the apparatus is achieved by driving a moving member configured to switch the conveyance route of the sheet by using the same drive source configured to rotate only in one direction, and a conveyance roller configured to discharge the sheet out of the machine or switch back and convey the sheet to the duplex conveying path.

Specifically, the above-described image forming apparatus is configured to rotatably support a swinging gear on the moving member, and switch a drive transmission route from the drive source to a discharge roller depending on the position of the swinging gear swinging together with the moving member configured to be pivoted by a solenoid, so that the conveyance roller is configured to be forwardly and reversely rotatable.

Japanese Patent Laid-Open No. 2006-56627 discloses an image forming apparatus configured to distribute a drive force of one motor into the conveyance roller and the moving member configured to switch a conveyance path of the sheet, and including a one way hinge having a torque limiter function arranged in a power transmission route from the motor to the moving member.

In the image forming apparatus, the moving member is driven and abuts against an abutting portion, so that the one way hinge functions as the torque limiter to prevent an excess load from being applied to the moving member, whereby the moving member is positioned.

However, in the image forming apparatus described in Japanese Patent Laid-Open No. 2007-76881, a relatively large force is required in the solenoid in order to maintain the swinging gear rotatably supported by the moving member in a state of engaging other gears or to disengage the swinging gear from other gears.

In the image forming apparatus disclosed in Japanese Patent Laid-Open No. 2006-56627, an idling torque of the one-way hinge needs to be set to be sufficiently larger than an inertia moment of the moving member. Therefore, when the moving member abuts against the abutting portion, a torque is continuously applied to the moving member until exceeding the idling torque, and hence energy loss occurs. Therefore, the image forming apparatus of the related art needs a relatively large energy for driving the conveyance roller and the moving member.

SUMMARY OF THE INVENTION

According to one aspect of the invention, a sheet conveying apparatus includes a conveying member rotating and conveying a sheet, a moving member configured to be movable between a first guiding position and a second guiding position, the moving member guiding the sheet to a first conveyance path in the first guiding position and guiding the sheet to a second conveyance path in the second guiding position, a first abutting portion configured to stop the moving member at the first guiding position by coming into abutment with the moving member having moved from the second guiding position to the first guiding position, a second abutting portion configured to stop the moving member at the second guiding position by coming into abutment with the moving member having moved from the first guiding position to the second guiding position, and a planetary gear mechanism including a first rotating element configured to rotate in a first direction and a second direction which is opposite to the first direction, a second rotating element configured to engage with the first rotating element and rotate the conveying member by drivenly rotating with the first rotating element, and a third rotating element configured to engage with the first rotating element, the third rotating element configured to move the moving member from the second guiding position to the first guiding position by drivenly rotating with the first rotating element rotating in the first direction, and move the moving member from the first guiding position to the second guiding position by drivenly rotating with the first rotating element rotating in the second direction.

Further features of the invention will become apparent from the following description of exemplary embodiments with reference to the attached drawings.

DESCRIPTION OF THE EMBODIMENTS

Hereinafter, an image forming apparatus according to an embodiment of this disclosure is described with reference to the drawings. The image forming apparatus according to the embodiment of this disclosure is an image forming apparatus configured to be capable of forming images on both sides (first side and second side) of a sheet such as a copier, a printer, a facsimile and a composite machine having a combination of these functions. The following embodiment will be described using an electrophotographic laser printer (hereinafter, referred to as a "printer").

<First Embodiment>

Figure 1:
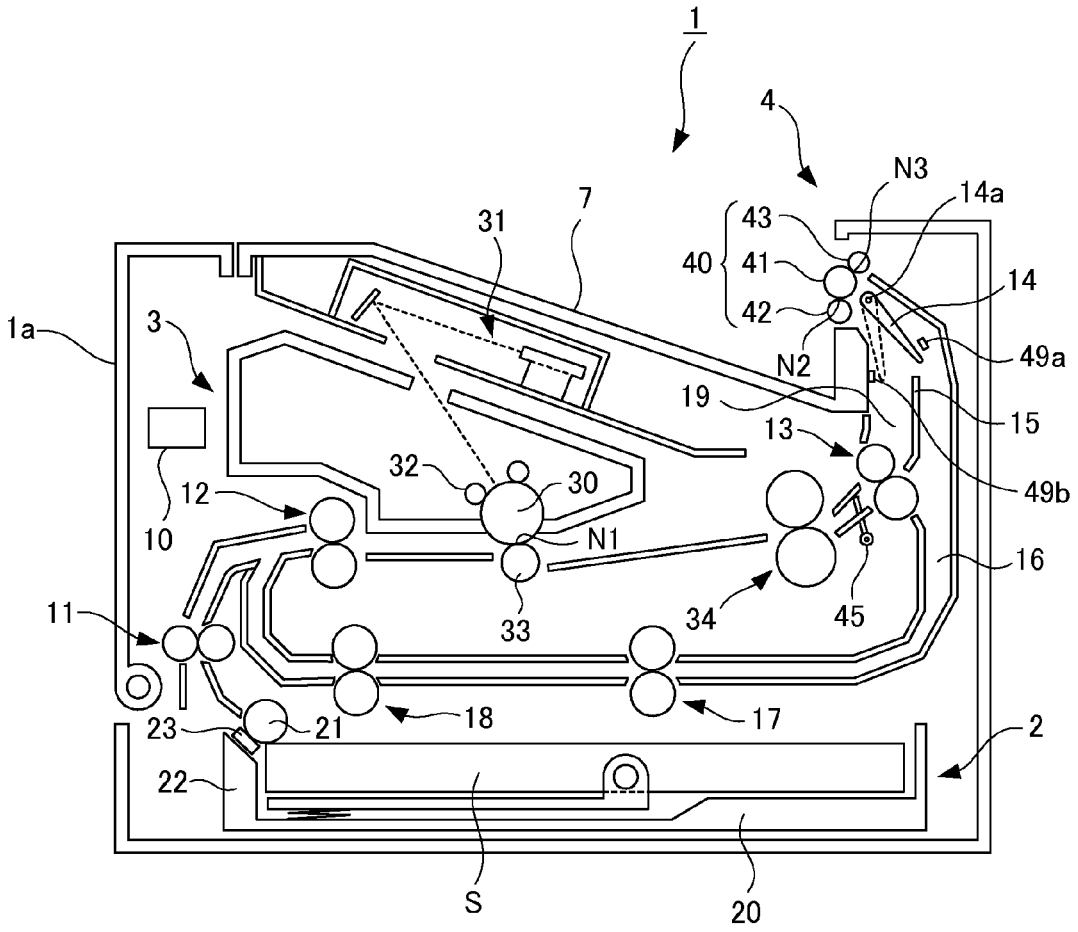
FIG. 1 is a section view schematically illustrating a printer according to a first embodiment of this disclosure.
Figure 2:
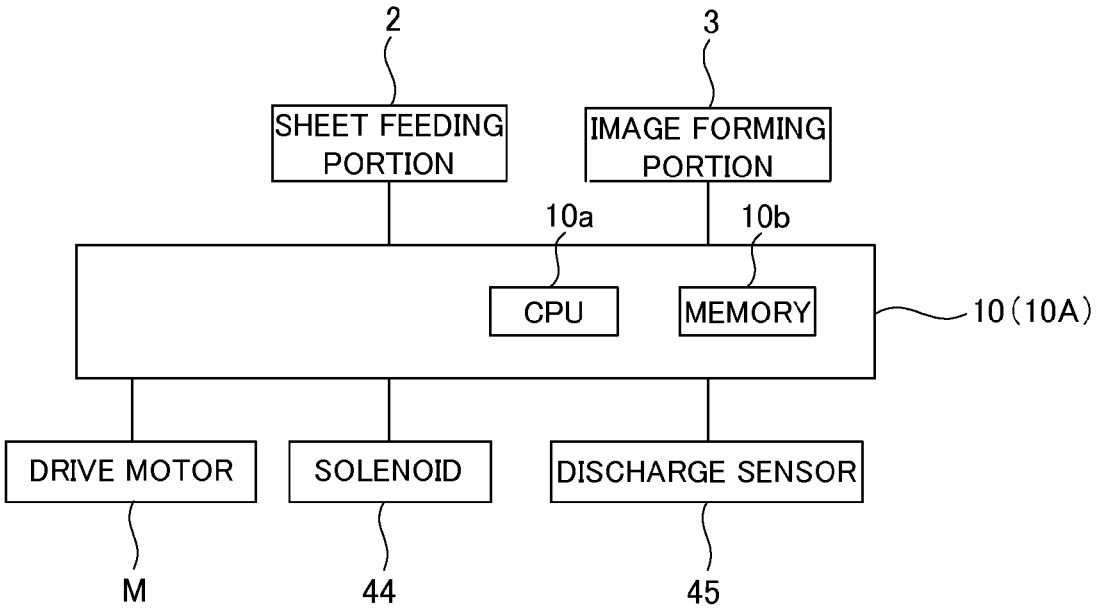
FIG. 2 is a block diagram illustrating a configuration of a controller of the printer according to the first embodiment of this disclosure.

A printer 1 according to a first embodiment will be described with reference to FIGS. 1 to 8C. First of all, a schematic configuration of the printer 1 will be described with reference to FIGS. 1 and 2. FIG. 1 is a section view schematically illustrating the printer 1 according to the first embodiment of this disclosure. FIG. 2 is a block diagram illustrating a configuration of a controller 10 of the printer 1 according to the first embodiment of this disclosure.

As illustrated in FIG. 1 and FIG. 2, the printer 1 includes a sheet feeding portion 2 configured to feed a sheet S, an image forming portion 3 configured to form an image on the sheet S, and a discharge inverting unit (sheet conveying apparatus, drive transmission apparatus) 4 capable of discharging the sheet S out of the machine and switching back and conveying the sheet S into the machine. The printer 1 also includes the controller 10 configured to control a sheet feeding portion 2, the image forming portion 3 and the discharge inverting unit 4.

The sheet feeding portion 2 includes a feed sheet stacking portion 20 having sheets S stacked thereon, a feeding roller 21 configured to feed the sheets S stacked on the feed sheet stacking portion 20, and a separation portion 22 having a separating pad 23 and configured to separate the sheets S fed by the feeding roller 21 one by one.

The image forming portion 3 includes a photosensitive drum 30, an exposure unit 31 configured to form an electrostatic latent image on the photosensitive drum 30, a developing portion configured to develop the electrostatic latent image, a transfer roller 33 configured to transfer a toner image to the sheet S, and a fixing portion 34 configured to fix the toner image transferred to the sheet S.

The discharge inverting unit 4 includes discharge inverting 3-consecutive rollers (sheet conveying portion) 40, a drive motor (drive source) M and a solenoid (actuator) 44 (see FIG. 2), a moving member 14, a first stopper (first abutting portion) 49*a* and a second stopper (second abutting portion) 49*b*, and a drive mechanism (see FIG. 4A and FIG. 4B described later) 5.

The discharge inverting 3-consecutive rollers (conveying member) 40 include a forwardly and reversely rotatable discharge inverting roller (conveying roller, rotating member) 41, and a discharge roller (first roller) 42 constituting a discharge nip N2 by coming into press contact with the discharge inverting roller 41. The discharge inverting 3-consecutive rollers 40 are provided with an inverting roller (second roller) 43 configured to come into press contact with the discharge inverting roller 41 and constitute part of an inverting nip N3.

The drive motor M is connected to the drive mechanism 5 via a drive train (transmission route) not illustrated. The transmission route of a drive force from the drive motor M is switched by turning the solenoid 44 ON and OFF at the drive train, whereby the direction of the drive force input to the drive mechanism 5 may be switched between a normal rotation and a reverse rotation. The solenoid 44 is turned ON and OFF on the basis of a detection signal from a discharge sensor 45 provided downstream of the fixing portion 34, and is configured to be capable of being driven on the basis of the position of the sheet S calculated, for example, by the detection signal from the discharge sensor 45.

In this embodiment, the solenoid 44 is used for changing the direction of the drive force to be transmitted to the drive mechanism 5 from the drive motor M. However, other actuators such as a servo motor or a linear actuator may be used. The drive motor M may be, for example, a drive source of the fixing portion 34, whereby further simplification is achieved.

The moving member 14 is configured to be capable of pivoting about a pivotal axis 14*a* located in the vicinity of the discharge inverting roller 41 to guide the conveyed sheet S. The first stopper 49*a* comes into abutment with the moving member 14, and positions the moving member 14 at a first guiding position (see FIG. 3A and FIG. 3C, described later, first position) where the sheet S can be guided to the discharge nip (first conveyance path) N2 or a duplex conveying path 16.

The second stopper 49*b* comes into abutment with the moving member 14, and positions the moving member 14 at a second guiding position (see FIG. 3B, described later, second position) where the sheet S can be guided to the inverting nip (second conveyance path) N3. The drive mechanism 5 distributes (transmits) the drive force from the drive motor M to the discharge inverting roller 41 and the moving member 14. The drive mechanism 5 will be described in detail later.

As illustrated in FIG. 2, the controller 10 includes a CPU 10*a* configured to control driving of the sheet feeding portion 2, the solenoid 44 and the like, and a memory 10*b* configured to memorize various programs and the like. The controller 10 is connected to the sheet feeding portion 2 and the image forming portion 3, and is connected to the drive motor M, the solenoid 44, and the discharge sensor 45.

Figure 3A:
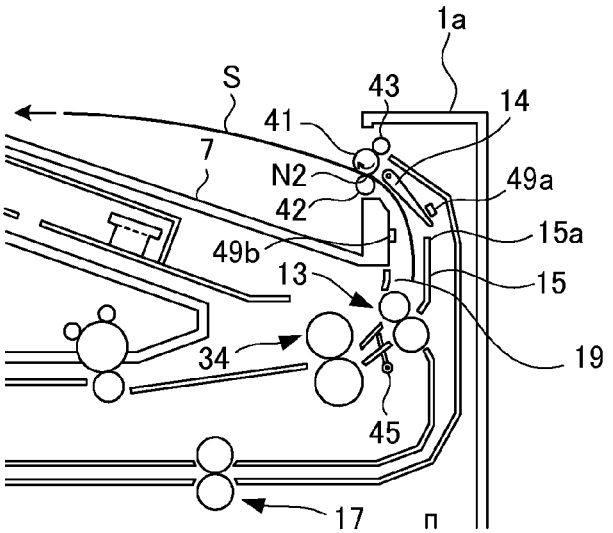
FIG. 3A is an explanatory drawing of an image forming job of the printer according to the first embodiment of this disclosure, illustrating a state of a sheet being discharged out of a machine by a discharge nip.
Figure 3B:
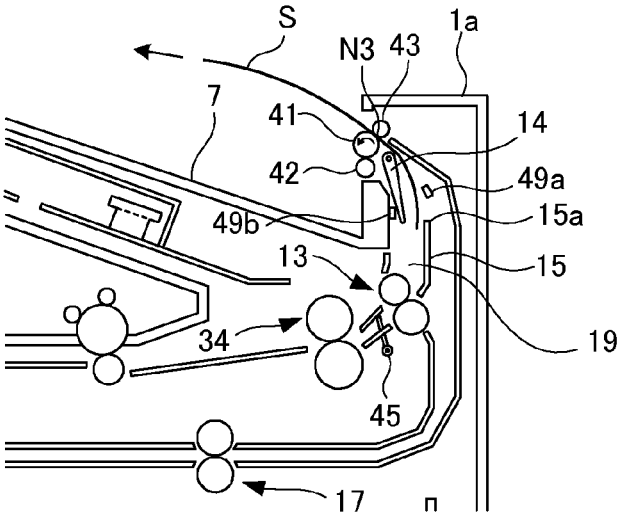
FIG. 3B is an explanatory drawing of the image forming job of the printer according to the first embodiment of this disclosure, illustrating a state of part of the sheet being conveyed out of a machine by an inverting nip.
Figure 3C:
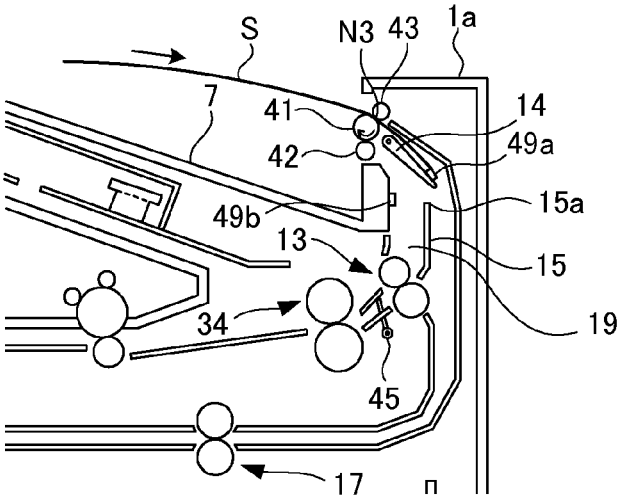
FIG. 3C is an explanatory drawing of the image forming job of the printer according to the first embodiment of this disclosure, illustrating a state of the sheet being switched back and conveyed by the inverting nip.

Subsequently, an image forming job of the printer 1 (an image forming control by the controller 10) will be described with reference to FIG. 3A, FIG. 3B, and FIG. 3C in addition to FIG. 1. FIG. 3A is an explanatory drawing of the image forming job of the printer 1 according to the first embodiment of this disclosure, illustrating a state of a sheet being discharged out of the machine by the discharge nip N2. FIG. 3B is a drawing illustrating a state of part of the sheet being conveyed out of the machine by the inverting nip N3 in the image forming job. FIG. 3C is a drawing illustrating a state of the sheet being switched back and conveyed by the inverting nip N3 in the image forming job. Description about the image forming job given below is controlled by the controller 10.

When the image forming job is started, the exposure unit 31 irradiates a surface of the photosensitive drum 30 with a laser beam in accordance with an image information signal transmitted from a personal computer or a scanner, not illustrated. Accordingly, the surface of the photosensitive drum 30 charged at predetermined polarity and potential is exposed, and an electrostatic latent image is formed on the surface of the photosensitive drum 30. When the electrostatic latent image is formed on the photosensitive drum 30, the developing portion 32 develops the electrostatic latent image, and the electrostatic latent image is visualized as a toner image.

In parallel to the toner image forming action described above, the feeding roller 21 feeds the sheets S stacked on the feed sheet stacking portion 20, and the separating pad 23 of the separation portion 22 separates the sheets S one by one (feed after separation). The sheet S fed after separation is conveyed by a conveyance roller pair 11 provided downstream of the sheet feeding portion 2, and is conveyed to a transfer nip N1 between the photosensitive drum 30 and the transfer roller 33 by a registration roller pair 12 provided further downstream at a predetermined timing.

When the sheet S is conveyed to the transfer nip N1, the transfer roller 33 transfers the toner image formed on the photosensitive drum 30 to the sheet S. The sheet S having the toner image transferred thereto is conveyed through a conveyance path 19 by the fixing portion 34 provided downstream of the transfer nip N1, and the toner image is fixed by heat and pressure in the fixing portion 34.

When a leading edge of the sheet S having the toner image fixed thereto is detected by the discharge sensor 45, the discharge inverting roller 41 pivots clockwise, and the moving member 14 pivots counterclockwise. Hereinafter, a direction of rotation of the discharge inverting roller 41 indicated by an arrow in FIG. 3A is assumed to be a clockwise rotation, and a direction of rotation of the discharge inverting roller 41 indicated by an arrow in FIG. 3B is assumed to be a counterclockwise rotation.

As regards other members that rotate about an axis parallel to an axis of rotation 41*a* (see FIG. 4A) of the discharge inverting roller 41, the direction of rotation is described with reference to the clockwise rotation and the counterclockwise rotation. The moving member 14 stops at the first guiding position by abutting against the first stopper 49*a*. Accordingly, the sheet S can be conveyed toward the discharge nip N2 by a conveyance roller pair 13 provided downstream of the fixing portion 34. When the sheet S is conveyed to the discharge nip N2, the sheet S is discharged out of the machine by the discharge inverting roller 41 configured to rotate clockwise and the discharge roller 42 configured to rotate by being driven by the discharge inverting roller 41 as illustrated in FIG. 3A, and the sheet S is stacked on a discharge sheet stacking unit 7 provided on an upper surface of a printer body (housing) 1*a*.

In contrast, in the case where images are formed on both sides of the sheet S, if the discharge sensor 45 detects the leading edge of the sheet S, the discharge inverting roller 41 rotates counterclockwise and the moving member 14 pivots clockwise. The moving member 14 stops at the second guiding position by abutting against the second stopper 49*b*. Accordingly, conveyance of the sheet S by the conveyance roller pair 13 toward the inverting nip N3 is enabled.

When the sheet S is conveyed to the inverting nip N3, part of the sheet S is discharged out of the machine by the discharge inverting roller 41 configured to rotate counterclockwise and the inverting roller 43 configured to rotate by being driven by the discharge inverting roller 41 as illustrated in FIG. 3B. When a trailing edge of the sheet S passes through an end portion 15*a* of a conveyance guide 15, the discharge inverting roller 41 is rotated clockwise. The fact that the trailing edge of the sheet S passes through the end portion 15*a* of the conveyance guide 15 is determined by the controller 10 on the basis of the position of the sheet calculated, for example, by the detection signal from the discharge sensor 45 and the sheet size. When the discharge inverting roller 41 rotates clockwise, the sheet S is switched back and the moving member 14 pivots to the first guiding position as illustrated in FIG. 3C, so that the sheet S moves to the duplex conveyance path 16.

The sheet S moved to the duplex conveyance path 16 is conveyed to the registration roller pair 12 again by a duplex conveyance roller pair 17 and a conveyance roller pair 18, and is conveyed to the transfer nip N1 at a predetermined timing. An image is formed on the second side of the sheet S conveyed to the transfer nip N1 by the same actions as described above, and the sheet S is guided to the moving member 14 at the first guiding position and is stacked on the discharge sheet stacking unit 7.

Figure 4A:
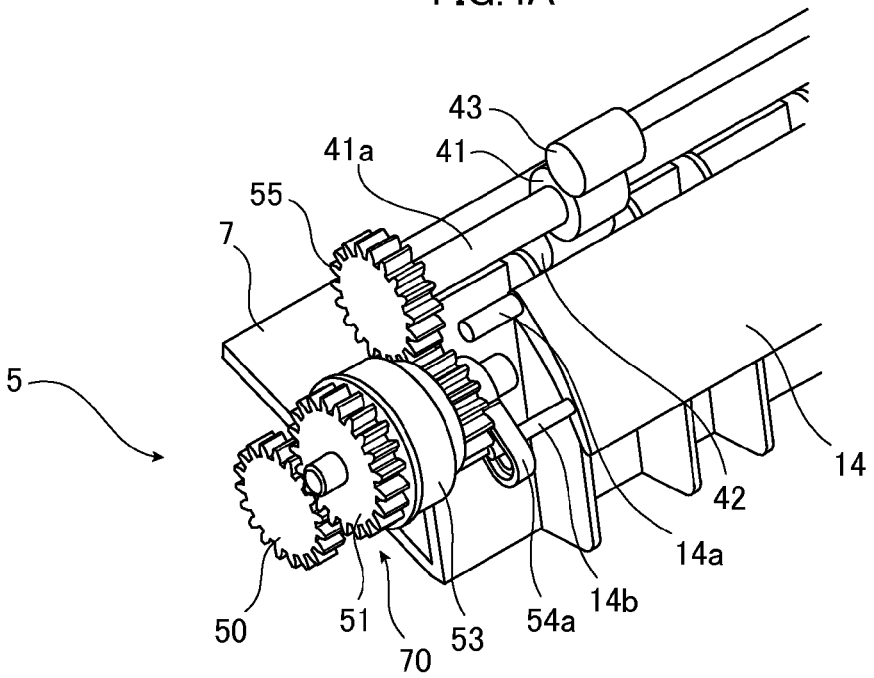
FIG. 4A is a perspective view illustrating the drive mechanism according to the first embodiment of this disclosure.
Figure 4B:
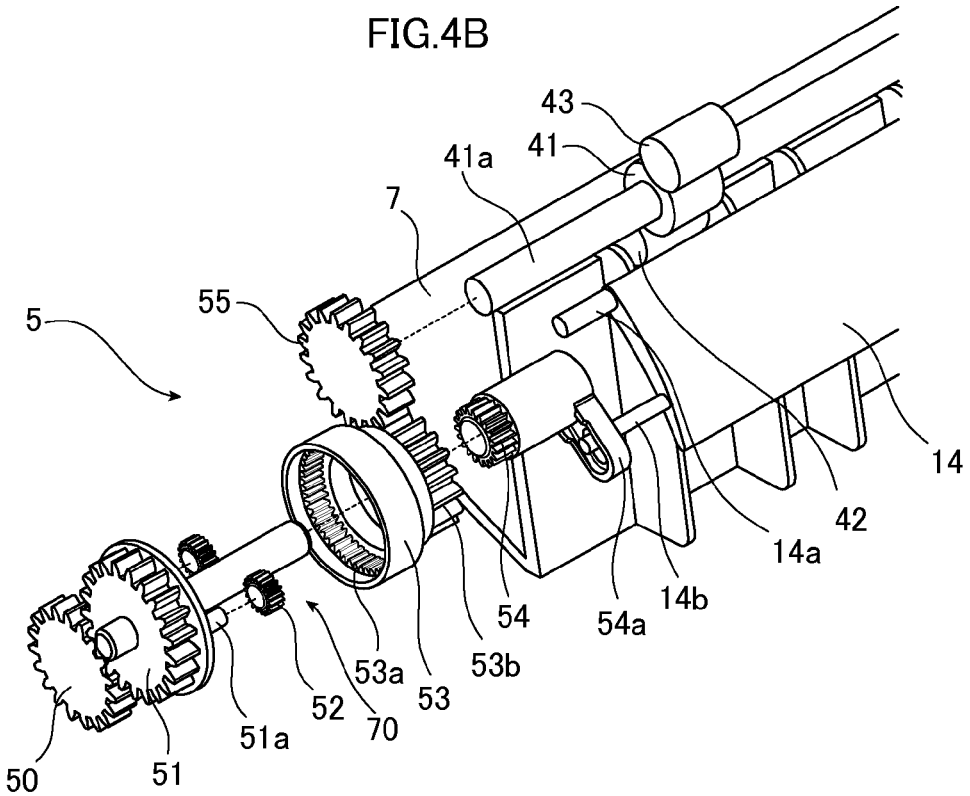
FIG. 4B is an exploded perspective view illustrating a drive mechanism according to the first embodiment of this disclosure.

Subsequently, the drive mechanism 5 described above will be described with reference to FIGS. 4A to 8C. First of all, a configuration of the drive mechanism 5 will be described with reference to FIG. 4A and FIG. 4B. FIG. 4A is a perspective view illustrating the drive mechanism 5 according to the first embodiment of this disclosure, and FIG. 4B is an exploded perspective view of the drive mechanism 5. In FIG. 4A and FIG. 4B, support portions of respective components and a conveyance guide and the like being unnecessary for description are omitted.

As illustrated in FIG. 4A and FIG. 4B, the drive mechanism 5 includes an input gear 50, a planetary gear mechanism 70, and a discharge inverting roller gear 55. The solenoid 44 switches the drive train, not illustrated, whereby the input gear is enabled to transmit the rotation (drive force) from the drive motor M while switching the direction of rotation to a normal rotation or a reverse rotation (clockwise or counterclockwise).

The planetary gear mechanism 70 includes a revolving gear (planetary carrier) 51 engaging the input gear 50, an internally-toothed gear (second rotating element) 53, and a sun gear (third rotating element) 54. The revolving gear 51 includes a pair of revolving bosses 51*a* and 51*a*. The pair of revolving bosses 51*a* and 51*a* rotatably supports a pair of planetary gears (first rotating element) 52 and 52, and the pair of planetary gears 52 and 52 held by the pair of revolving bosses 51*a* and 51*a* is in engagement with the sun gear 54 provided coaxially with the revolving gear 51. The sun gear 54 is coupled to a boss portion 14*b* of the moving member 14 via a coupling portion 54*a*, so that the moving member 14 rotates about the pivotal axis 14*a* by the rotation of the sun gear 54.

The pair of planetary gears 52 and 52 engages an internal tooth 53*a* formed on an inner peripheral portion of the internally-toothed gear 53 disposed coaxially with the revolving gear 51 via the sun gear 54. The internally-toothed gear 53 is provided with an external tooth 53*b* formed on an outer peripheral portion. The external tooth 53*b* engages the discharge inverting roller gear 55 coupled to the axis of rotation 41*a* of the discharge inverting roller 41, so that the discharge inverting roller 41 is allowed to rotate.

Subsequently, an action to be taken when discharging the sheet S by the drive mechanism 5 configured as described above (sheet discharging action) and an action when performing inverting conveyance of the sheet S (sheet inverting conveyance action) will be described with reference to FIG. 5A to FIG. 8C.

Figure 5A:
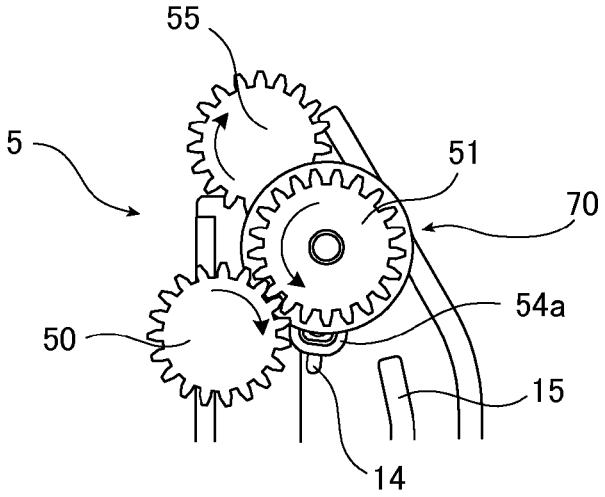
FIG. 5A is a side view illustrating a direction of rotation of the drive mechanism when a moving member according to the first embodiment of this disclosure pivots from a second guiding position to a first guiding position.
Figure 5B:
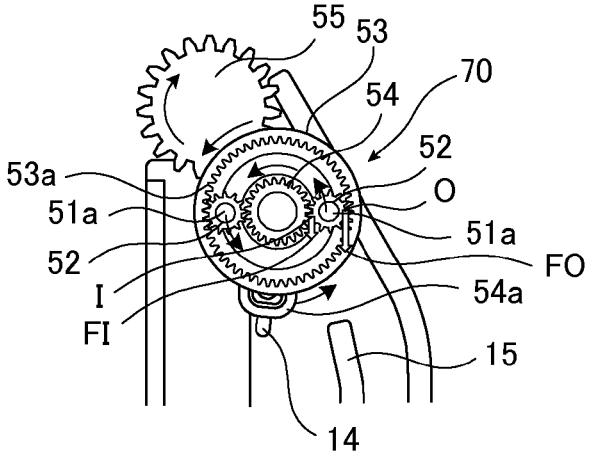
FIG. 5B is a side view illustrating a direction of rotation of a planetary gear mechanism when the moving member according to the first embodiment of this disclosure pivots from the second guiding position to the first guiding position.
Figure 5C:
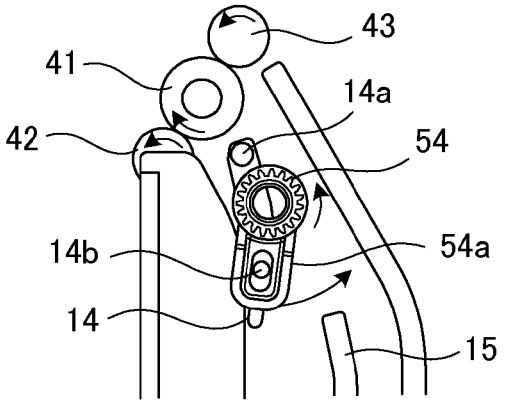
FIG. 5C is a side view illustrating a direction of rotation of a discharge inverting roller when the moving member according to the first embodiment of this disclosure pivots from the second guiding position to the first guiding position.
Figure 6A:
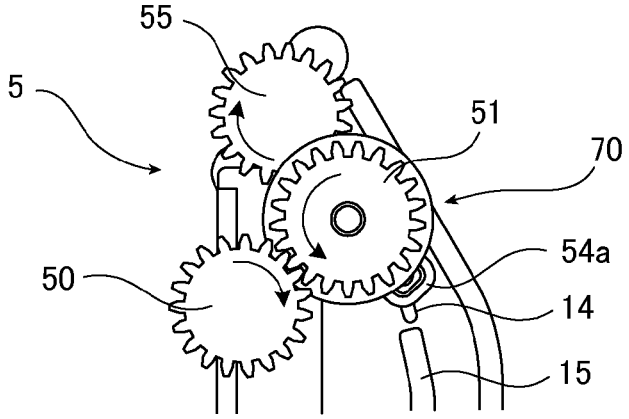
FIG. 6A is a side view illustrating a direction of rotation of the drive mechanism after the moving member according to the first embodiment of this disclosure has moved to the first guiding position.
Figure 6B:
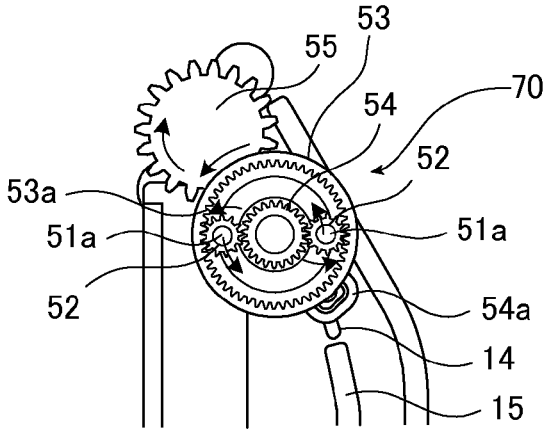
FIG. 6B is a side view illustrating a direction of rotation of the planetary gear mechanism after the moving member according to the first embodiment of this disclosure has moved to the first guiding position.
Figure 6C:
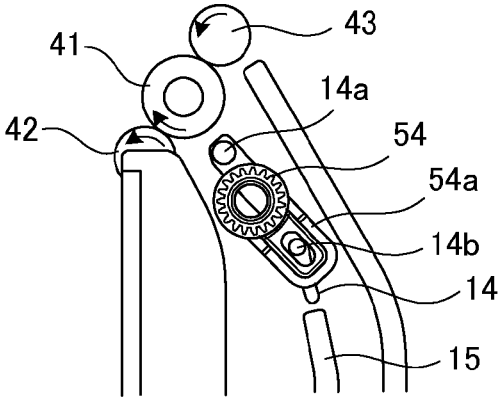
FIG. 6C is a side view illustrating a direction of rotation of the discharge inverting roller after the moving member according to the first embodiment of this disclosure has moved to the first guiding position.

First of all, the action to be taken by the drive mechanism 5 for discharging the sheet S will be described with reference to FIG. 5A to FIG. 6C. FIG. 5A is a side view illustrating a direction of rotation of the drive mechanism 5 when the moving member 14 according to the first embodiment of this disclosure pivots from the second guiding position to the first guiding position. FIG. 5B is a side view illustrating the direction of rotation of the planetary gear mechanism 70 in the state of FIG. 5A, and FIG. 5C is a side view illustrating the direction of rotation of the discharge inverting roller 41. FIG. 6A is a side view illustrating the direction of rotation of the drive mechanism 5 after the moving member 14 according to the first embodiment of this disclosure has moved to the first guiding position. FIG. 6B is a side view illustrating the direction of rotation of the planetary gear mechanism 70 in the state of FIG. 6A, and FIG. 6C is a side view illustrating the direction of rotation of the discharge inverting roller 41.

In a state of the moving member 14 being located at the second guiding position as illustrated in FIG. 5A, the controller 10 controls the solenoid 44 so that the input gear 50 rotates clockwise by an input of the drive force from the drive motor M. When the input gear 50 rotates clockwise, the revolving gear 51 in engagement with the input gear 50 rotates counterclockwise (first direction). When the revolving gear 51 rotates counterclockwise, the pair of revolving bosses 51*a* and 51*a* revolves counterclockwise about the center of rotation of the revolving gear 51 as an axis of revolution as illustrated in FIG. 5B.

Here, a portion where the internal tooth 53*a* of the internally-toothed gear 53 and the planetary gear 52 engage is defined as an engaging portion O, and a portion where the sun gear and the planetary gear 52 engage is defined as an engaging portion I. At the engaging portion O, a load FO proportional to a rotation torque of the discharge inverting roller 41 is applied to a tooth surface of the planetary gear 52 in a direction causing the planetary gear 52 to rotate clockwise.

In contrast, at the engaging portion I, a load FI proportional to a torque for pivoting the moving member 14 against its own weight is applied to the tooth surface of the planetary gear 52 in a direction of causing the planetary gear 52 to rotate counterclockwise. In other words, the load FO and the load FI work in directions of preventing the rotation of the planetary gear 52

Therefore, the sun gear 54 and the internal tooth 53*a* receive a force to rotate counterclockwise by a revolving force of the pair of planetary gears 52 and 52. Consequently, as illustrated in FIG. 5C, the sun gear 54 rotates counterclockwise, and the coupling portion 54*a* coupled to the sun gear 54 rotates counterclockwise. Then, the moving member 14 coupled to the coupling portion 54*a* pivots counterclockwise from the second guiding position to the first guiding position, and stops pivoting by abutting against the first stopper 49*a*. Accordingly, the sheet S can be guided to the discharge nip N2.

In the same manner, the internally-toothed gear 53 rotates counterclockwise and the discharge inverting roller gear 55 in engagement with the external tooth 53*b* of the internally-toothed gear 53 rotates clockwise, so that the discharge inverting roller 41 rotates clockwise (normal rotation). Accordingly, the sheet S guided to the discharge nip N2 can be discharged to the discharge sheet stacking unit 7.

When the moving member 14 pivots in a direction opposite to the direction of gravitational force, the rotation torque of the discharge inverting roller 41, the weight of the moving member 14, and the numbers of teeth of the respective gears are set so that the load FO exceeds the load FI in order to prevent the sun gear 54 from being locked by the torque for pivoting the moving member 14.

As illustrated in FIG. 6A, after the moving member 14 has positioned at the first guiding position by abutting against the first stopper 49*a*, the input gear 50 rotates clockwise, and the revolving gear 51 rotates counterclockwise. As illustrated in FIG. 6B, the pair of revolving bosses 51*a* and 51*a* rotate counterclockwise. In contrast, as illustrated in FIG. 6C, when the moving member 14 abuts against the first stopper 49*a* and stops at the first guiding position, the sun gear 54 is fixed. In other words, the rotation of the sun gear 54 is regulated.

Therefore, the pair of planetary gears 52 and 52 rotate counterclockwise about the revolving boss 51*a* while revolving counterclockwise along the outer peripheral portion of the sun gear 54 in association with the revolution of the pair of revolving bosses 51*a* and 51*a*. Consequently, the internally-toothed gear 53 rotates at an increased speed counterclockwise by the rotation of the pair of planetary gears 52 and 52, and the discharge inverting roller 41 rotates at an increased speed clockwise. Accordingly, the sheet S guided to the discharge nip N2 is discharged to the discharge sheet stacking unit 7.

If the discharge inverting roller 41 rotates at an increased speed, the throughput is improved, and a takt time may be reduced. In other words, the productivity may be improved. Even though the sun gear 54 is fixed by the moving member 14 abutting against the first stopper 49*a*, the revolving gear 51, the planetary gears 52 and 52, and the internally-toothed gear 53 continue to rotate smoothly, so that the moving member 14 and the discharge inverting roller 41 can be smoothly driven.

Figure 7A:
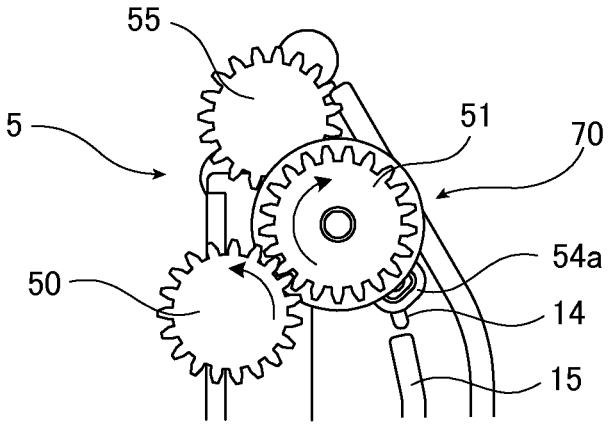
FIG. 7A is a side view illustrating a direction of rotation of the drive mechanism when the moving member according to the first embodiment of this disclosure pivots from the first guiding position to the second guiding position.
Figure 7B:
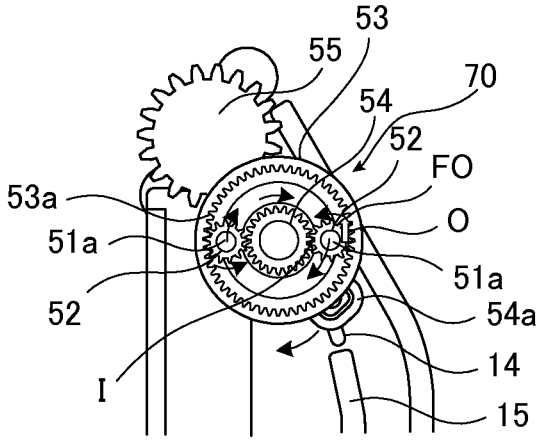
FIG. 7B is a side view illustrating a direction of rotation of the planetary gear mechanism when the moving member according to the first embodiment of this disclosure pivots from the first guiding position to the second guiding position.
Figure 7C:
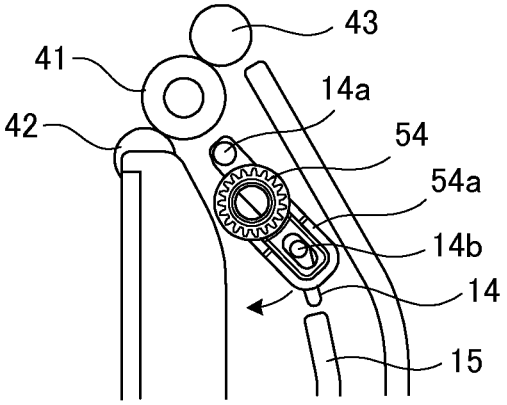
FIG. 7C is a side view illustrating a direction of rotation of the discharge inverting roller when the moving member according to the first embodiment of this disclosure pivots from the first guiding position to the second guiding position.
Figure 8A:
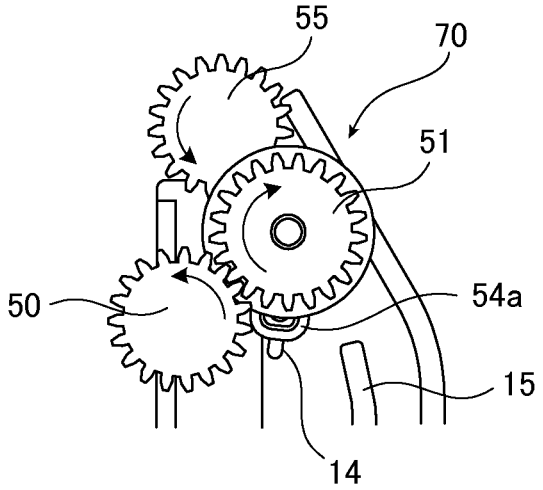
FIG. 8A is a side view illustrating a direction of rotation of the drive mechanism after the moving member according to the first embodiment of this disclosure has moved to the second guiding position.
Figure 8B:
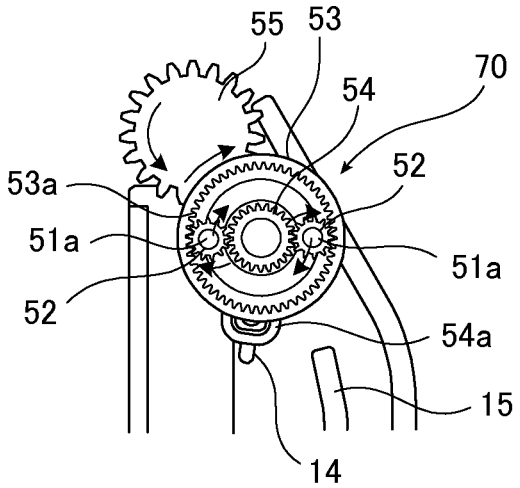
FIG. 8B is a side view illustrating a direction of rotation of the planetary gear mechanism after the moving member according to the first embodiment of this disclosure has moved to the second guiding position.
Figure 8C:
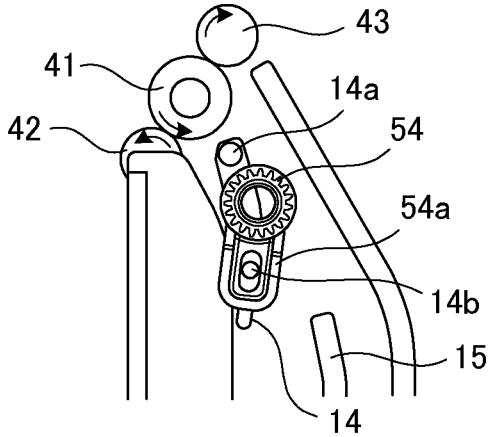
FIG. 8C is a side view illustrating a direction of rotation of the discharge inverting roller after the moving member according to the first embodiment of this disclosure has moved to the second guiding position.

Subsequently, the sheet inverting conveyance action by the drive mechanism 5 will be described with reference to FIG. 7A to FIG. 8C. FIG. 7A is a side view illustrating the direction of rotation of the drive mechanism 5 when the moving member 14 according to the first embodiment of this disclosure pivots from the first guiding position to the second guiding position. FIG. 7B is a side view illustrating the direction of rotation of the planetary gear mechanism in the state of FIG. 7A, and FIG. 7C is a side view illustrating the direction of rotation of the discharge inverting roller. FIG. 8A is a side view illustrating a direction of rotation of the drive mechanism 5 after the moving member 14 according to the first embodiment of this disclosure has moved to the second guiding position. FIG. 8B is a side view illustrating the direction of rotation of the planetary gear mechanism in the state of FIG. 8A, and FIG. 8C is a side view illustrating the direction of rotation of the discharge inverting roller.

In a state of the moving member 14 being located at the first guiding position as illustrated in FIG. 7A, the controller controls the solenoid 44 so that the input gear 50 rotates counterclockwise by an input of the drive force from the drive motor M. When the input gear 50 rotates counterclockwise, the revolving gear 51 in engagement with the input gear 50 rotates clockwise. When the revolving gear 51 rotates clockwise, the pair of revolving bosses 51*a* and 51*a* revolves clockwise about the center of rotation of the revolving gear 51 as an axis of revolution as illustrated in FIG. 7B.

At the engaging portion O, the load FO proportional to the rotation torque of the discharge inverting roller 41 is applied to the tooth surface of the planetary gear 52 in the direction causing the planetary gear 52 to rotate counterclockwise. In contrast, the moving member 14 is about to rotate in the direction of gravitational force under its own weight. At this time, the drive motor M is set to a predetermined speed so that the load is hardly applied to the tooth surface of the planetary gear 52 in the engaging portion I. In other words, the revolving speed of the planetary gear 52 and the rotational speed of the sun gear 54 clockwise under its own weight satisfy a predetermined relationship, and the load of the sun gear 54 is set to be next to zero.

Therefore, the pair of planetary gears 52 and 52 rotates counterclockwise while revolving clockwise along the inner peripheral portion of the internal tooth 53*a*. Since the load of the sun gear 54 is set to be next to zero, the rotational force is not transmitted to the internally-toothed gear 53. Consequently, as illustrated in FIG. 7C, the moving member 14 starts to rotate clockwise about the pivotal axis 14*a* of the switching member 14, and stops when abutting against the second stopper 49*b*. While the moving member 14 pivots clockwise, the internally-toothed gear 53 does not rotate, and hence the drive force is not transmitted to the discharge inverting roller gear 55, and hence the discharge inverting roller 41 does not rotate.

As illustrated in FIG. 8A, after the moving member 14 has positioned at the second guiding position by abutting against the second stopper 49*b*, the input gear 50 rotates counterclockwise, and the revolving gear 51 continuously rotates clockwise (second direction). As illustrated in FIG. 8B, the pair of revolving bosses 51*a* and 51*a* rotates clockwise. In contrast, as illustrated in FIG. 8C, since the moving member 14 abuts against the second stopper 49*b* and stops at the second guiding position, the sun gear 54 is fixed.

Therefore, the pair of planetary gears 52 and 52 rotates clockwise about the revolving boss 51*a* while revolving clockwise along the outer peripheral portion of the sun gear 54 in association with the revolution of the pair of revolving bosses 51*a* and 51*a*. Consequently, the internally-toothed gear 53 rotates clockwise by the rotation of the pair of planetary gears 52 and 52, and the discharge inverting roller 41 rotates at an increased speed counterclockwise (reverse rotation). Accordingly, the sheet S is switched back and conveyed toward the duplex conveyance path 16.

As described above, the drive mechanism 5 of the discharge inverting unit 4 of this embodiment is a mechanism configured to drive the discharge inverting roller 41 and the moving member 14 by using the drive force of the drive motor M. Therefore, the maximum torque required for the input gear 50 corresponds to a sum of a rotation torque of the discharge inverting roller 41 and a rotation torque of the moving member 14. By using the planetary gear mechanism 70, the drive mechanism 5 according to this embodiment is capable of restraining the loss of the torque without applying an excessive torque to the moving member 14 when the moving member 14, for example, abuts against the first stopper 49*a* and the second stopper 49*b*. Consequently, the power consumption that operates the discharge inverting roller 41 and the moving member 14 may be reduced.

By using the planetary gear mechanism 70, if the moving member 14 stops at the first and second guiding positions, the speed of the rotation of the discharge inverting roller 41 can be increased. Accordingly, improvement of the throughput is achieved, and the tact time may be reduced. Consequently, improvement of productivity is achieved. When the moving member 14 pivots in the direction of gravitational force, the load of the sun gear 54 becomes substantially zero, and the internally-toothed gear 53 does not rotate. Therefore, energy (electric power) of the drive motor M for driving the discharge inverting roller 41 and the moving member 14 may be reduced.

The discharge inverting unit 4 of the printer 1 according to the embodiment is configured to have the conveyance route for discharging the sheet S and the conveyance route for inverting the sheet S separated from each other with the provision of the discharge inverting 3-consecutive rollers 40 and the moving member 14. Therefore, a sheet S to be discharged and a sheet to be switched back may be conveyed while intersecting each other while storing a plurality of the sheets S in the printer 1. Accordingly, improvement of productivity at the time of duplex printing is achieved.

<Second Embodiment>

Subsequently, a printer 1A according to a second embodiment of this disclosure will be described with reference to FIGS. 9 to 15C in addition to FIG. 2. The printer 1A according to the second embodiment is different from the first embodiment in that a discharge inverting roller pair 46 is provided instead of the discharge inverting 3-consecutive rollers 40, and in arrangement of the moving member. Therefore, in the second embodiment, a point different from the first embodiment, that is, the discharge inverting roller pair 46 and a moving member 14A will be described in detail.

Figure 9:
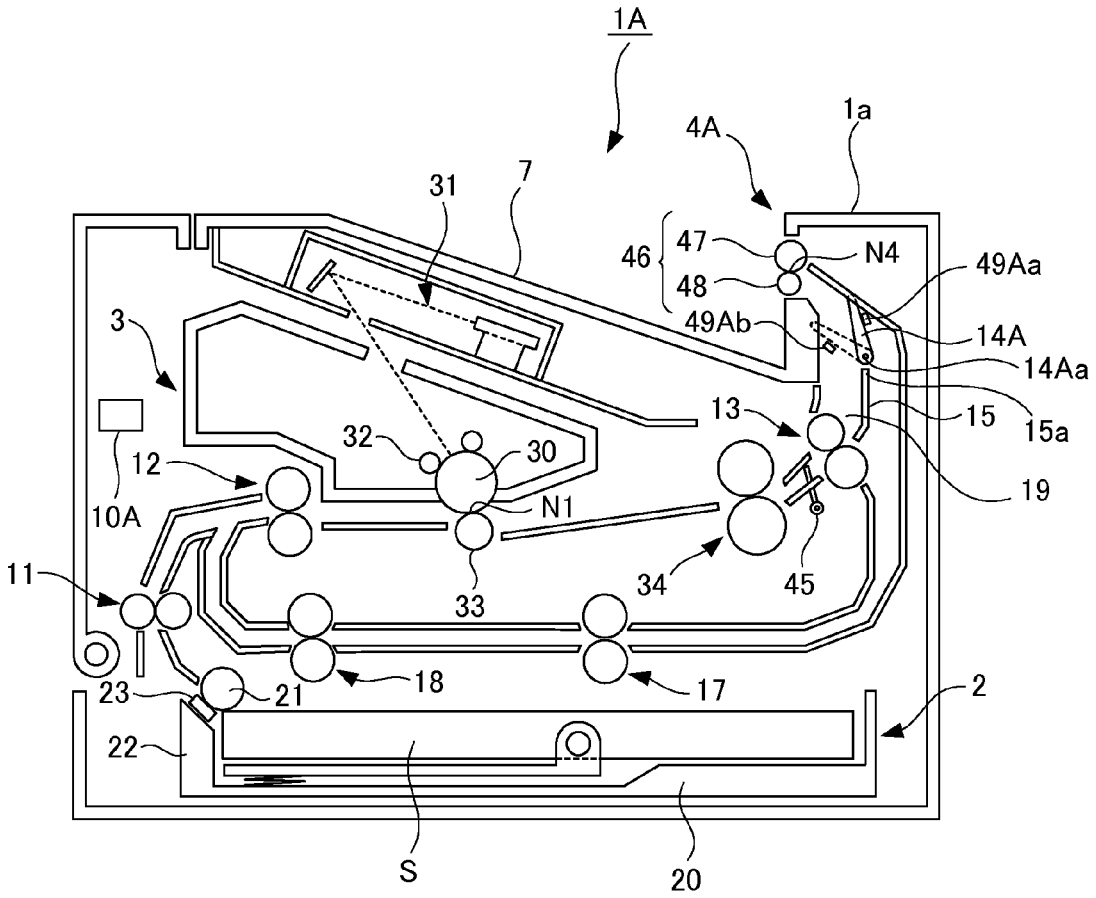
FIG. 9 is a section view schematically illustrating a printer according to a second embodiment of this disclosure.

As illustrated in FIG. 9 and FIG. 2, the printer 1A includes the sheet feeding portion 2, the image forming portion 3, a discharge inverting unit (sheet conveying apparatus, drive transmission apparatus) 4A capable of discharging the sheets S out of the machine and switching back and conveying the sheets in the machine, and a controller 10A. The discharge inverting unit 4A includes the discharge inverting roller pair (sheet conveying portion) 46, the drive motor M and the solenoid 44, the moving member 14A, the first and second stoppers 49Aa and 49Ab, and a drive mechanism (see FIG. 11A and FIG. 11B, described later) 5A.

The discharge inverting roller pair 46 includes a forwardly and reversely rotatable discharging inverting roller (conveying roller, rotating member) 47, and a discharge inverting roller (driven roller) 48 configured to come into press contact with the discharge inverting roller 47 and constitute part of a discharge inverting nip N4. The moving member 14A is arranged at a branch portion between the conveyance path 19 and the duplex conveyance path 16, and is configured to be capable of guiding the conveyed sheet S by pivoting about the pivotal axis 14Aa located in the vicinity of the end portion 15*a* of the conveyance guide 15.

The first stopper 49Aa comes into abutment with the moving member 14A, and positions the moving member 14A at a first guiding position (see FIG. 10A, described later) where the sheet S can be guided to the discharge inverting nip N4 of the discharge inverting roller pair 46. The second stopper 49Ab comes into abutment with the moving member 14A, and positions the moving member 14A at a second guiding position (see FIG. 10B, described later) where the switched-back sheet S can be guided to the duplex conveyance path 16. The drive mechanism 5A distributes the drive force from the drive motor M to the discharge inverting roller 47 and the moving member 14A. The drive mechanism 5A will be described in detail later.

As illustrated in FIG. 2, the controller 10A includes a CPU 10*a* configured to control driving of the sheet feeding portion 2, the solenoid 44 and the like, and the memory 10*b* configured to store various programs and the like.

Figure 10A:
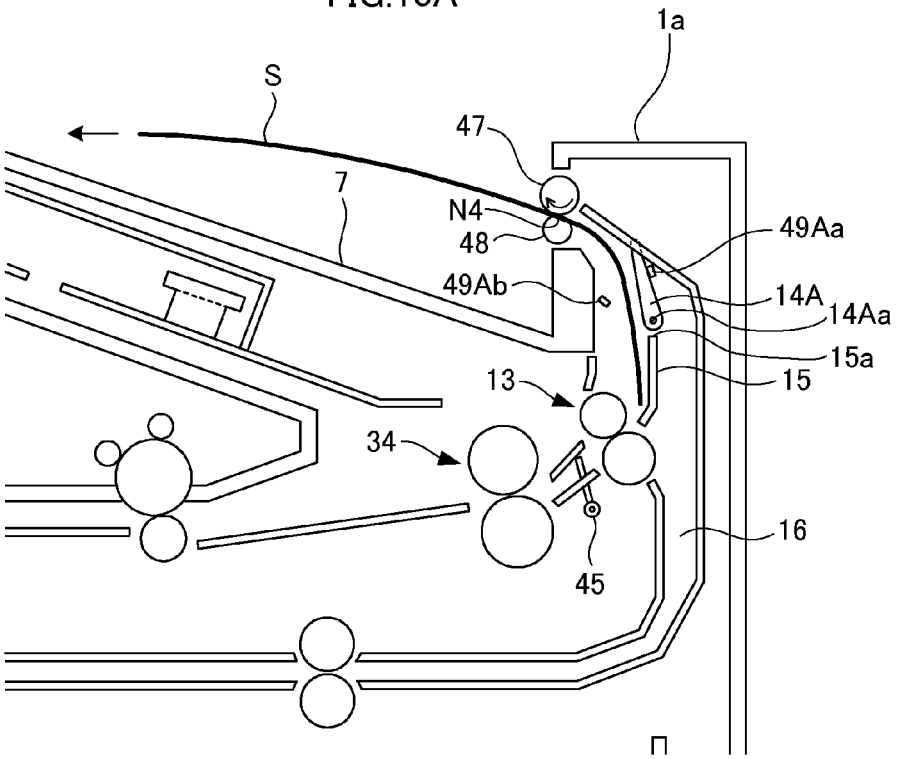
FIG. 10A is an explanatory drawing of an image forming job of the printer according to the second embodiment of this disclosure, illustrating a state of a sheet being conveyed out of the machine by a discharge inverting nip.
Figure 10B:
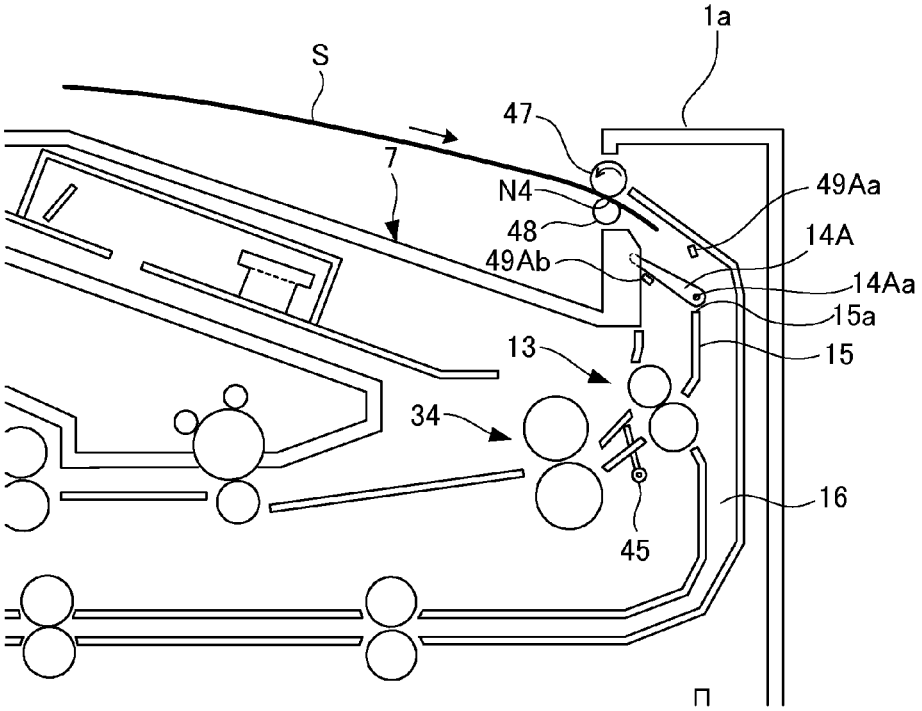
FIG. 10B is an explanatory drawing of the image forming job of the printer according to the second embodiment of this disclosure, illustrating a state of the sheet being switched back and conveyed by the discharge inverting nip.

Subsequently, an image forming job of the printer 1A (image forming control by the controller 10A) will be described with reference to FIG. 10A and FIG. 10B in addition to FIG. 9. FIG. 10A is an explanatory drawing of an image forming job of the printer 1A according to the second embodiment of this disclosure, illustrating a state of a sheet being discharged out of the machine by a discharge inverting nip. FIG. 10B is a drawing illustrating a state of the sheet being switched back and conveyed by the discharge inverting nip N4 in the image forming job. Description about the image forming job given below is controlled by the controller 10A. Since a procedure from the start of the image forming job until the toner image is fixed is the same as the first embodiment, description will be omitted.

When the toner image is fixed and a leading edge of the sheet S is sensed by the discharge sensor 45, the discharge inverting roller 47 rotates clockwise, and the moving member 14A pivots clockwise. The moving member 14A stops at the first guiding position by abutting against the first stopper 49Aa. Accordingly, the sheet S can be conveyed toward the discharge inverting nip N4 of the discharge inverting roller pair 46 by the conveyance roller pair 13 provided downstream of the fixing portion 34. When the sheet S is guided to the discharge inverting nip N4 of the discharge inverting roller pair 46, the sheet S is discharged out of the machine by the discharge inverting roller 47 configured to rotate clockwise and the discharge inverting roller 48 configured to rotate by being driven by the discharge inverting roller 47 as illustrated in FIG. 10A, and the sheet S is stacked on the discharge sheet stacking unit 7 provided on the upper surface of the printer body 1*a*.

In contrast, in the case where images are formed on both sides of the sheet S, if the trailing edge of the sheet S passes through a leading edge of the moving member 14A, the discharge inverting roller 47 rotates counterclockwise and the moving member 14A pivots counterclockwise. The fact that the trailing edge of the sheet S passes through the leading edge of the moving member 14A is determined by the controller 10A on the basis of the position of the sheet S calculated, for example, by the detection signal from the discharge sensor 45 and the sheet size. The moving member 14A stops at the second guiding position by abutting against the second stopper 49Ab as illustrated in FIG. 10B. Accordingly, the sheet S is allowed to be conveyed to the duplex conveying path 16, and after having been re-conveyed to the image forming portion 3, is stacked in the discharge sheet stacking unit 7 in the same manner as the first embodiment.

Figure 11A:
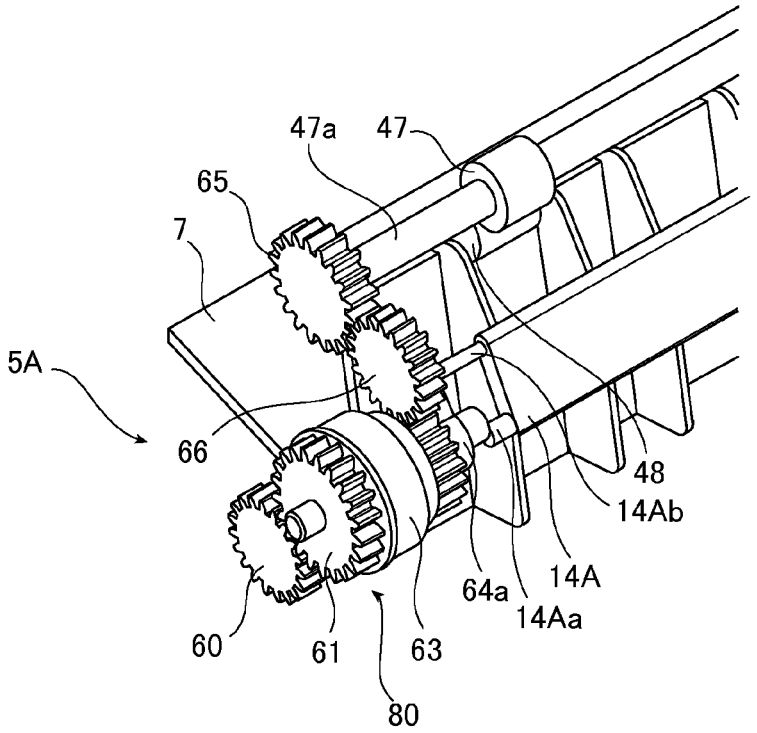
FIG. 11A is a perspective view illustrating a drive mechanism according to the second embodiment of this disclosure.
Figure 11B:
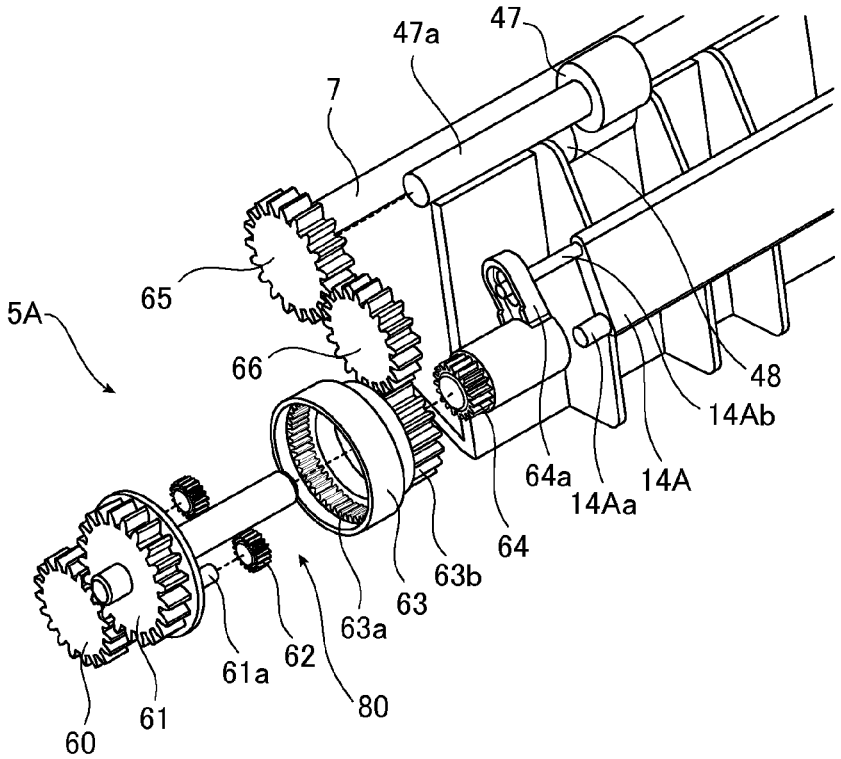
FIG. 11B is an exploded perspective view illustrating the drive mechanism according to the second embodiment of this disclosure.

Subsequently, the drive mechanism (planetary gear mechanism) 5A described above will be described with reference to FIGS. 11A to 15C. First of all, a configuration of the drive mechanism 5A will be described with reference to FIG. 11A and FIG. 11B. FIG. 11A is a perspective view illustrating the drive mechanism 5A according to the second embodiment, and FIG. 11B is an exploded perspective view of the drive mechanism 5A. In FIG. 11A and FIG. 11B, support portions of respective components and a conveyance guide and the like being unnecessary for description are omitted.

As illustrated in FIG. 11A and FIG. 11B, the drive mechanism 5A includes an input gear 60, a planetary gear mechanism 80, a discharge idler gear 66, and a discharge inverting roller gear 65. The solenoid 44 switches the drive train, not illustrated, whereby the input gear 60 is enabled to transmit the rotation (drive force) from the drive motor M while switching the direction of rotation to a normal rotation or a reverse rotation (clockwise or counterclockwise). The planetary gear mechanism 80 includes a revolving gear (planetary carrier) 61 engaging the input gear 60, an internally-toothed gear (second rotating element) 63, and a sun gear (third rotating element) 64. The revolving gear 61 includes a pair of revolving bosses 61*a* and 61*a*. The pair of revolving bosses 61*a* and 61*a* rotatably supports the pair of planetary gears (first rotating element) 62 and 62, and the pair of planetary gears 62 and 62 held by the pair of revolving bosses 61*a* and 61*a* is in engagement with the sun gear 64 provided coaxially with the revolving gear 61. The sun gear 64 is coupled to a boss portion 14Ab of the moving member 14A via a coupling portion 64*a*, so that the moving member 14A pivots about the pivotal axis 14Aa by the rotation of the sun gear 64.

The pair of planetary gears 62 and 62 is in engagement with an internal tooth 63*a* formed on an inner peripheral portion of the internally-toothed gear 63 disposed coaxially with the revolving gear 61 via the sun gear 64. The internally-toothed gear 63 is provided with an external tooth 63*b* formed on an outer peripheral portion thereof, and the external tooth 63*b* engages the discharge idler gear 66. The discharge idler gear 66 is in engagement with the discharge inverting roller gear 65 coupled to an axis of rotation 47*a* of the discharge inverting roller 47.

Subsequently, an action to be taken when discharging the sheet S by the drive mechanism 5A configured as described above (sheet discharging action) and an action to be taken when performing inverting conveyance of the sheet S (sheet inverting conveyance action) will be described with reference to FIG. 12A to FIG. 15C.

Figure 12A:
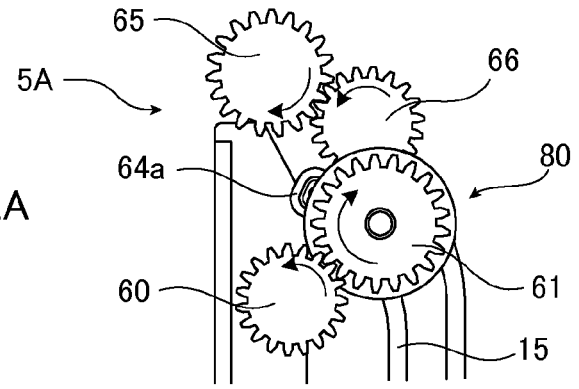
FIG. 12A is a side view illustrating a direction of rotation of the drive mechanism when a moving member according to the second embodiment of this disclosure pivots from a second guiding position to a first guiding position.
Figure 12B:
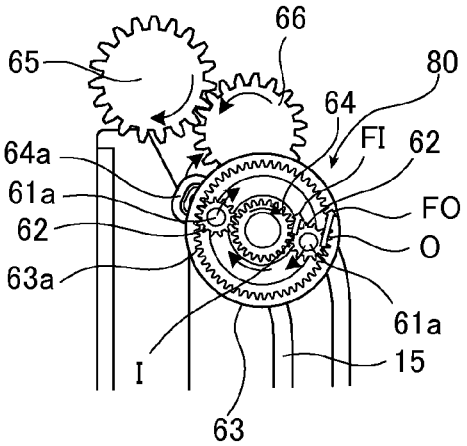
FIG. 12B is a side view illustrating a direction of rotation of a planetary gear mechanism when the moving member according to the second embodiment of this disclosure pivots from the second guiding position to the first guiding position.
Figure 12C:
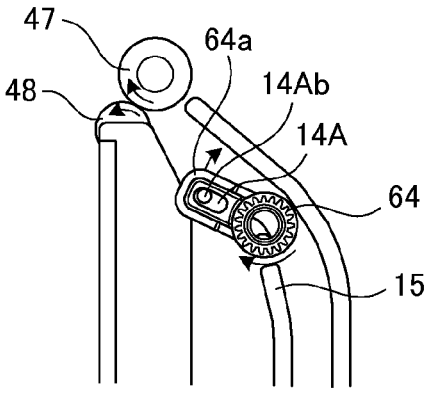
FIG. 12C is a side view illustrating a direction of rotation of a discharge inverting roller when the moving member according to the second embodiment of this disclosure pivots from the second guiding position to the first guiding position.
Figure 13A:
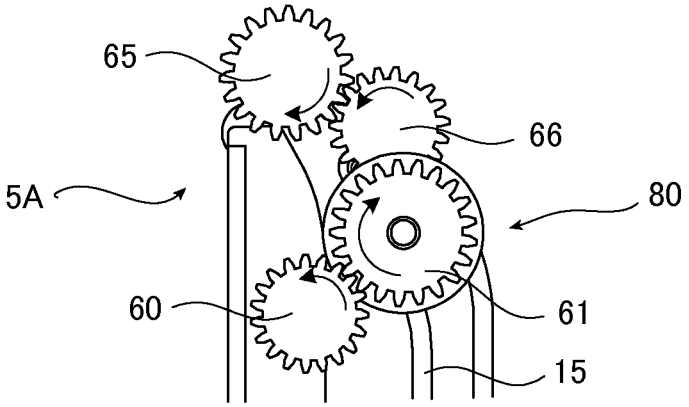
FIG. 13A is a side view illustrating a direction of rotation of the drive mechanism after the moving member according to the second embodiment of this disclosure has moved to the first guiding position.
Figure 13B:
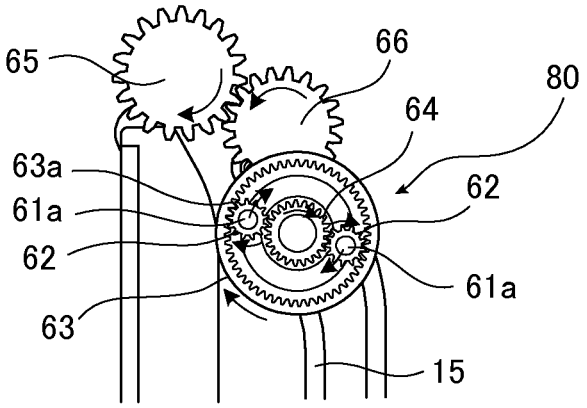
FIG. 13B is a side view illustrating a direction of rotation of the planetary gear mechanism after the moving member according to the second embodiment of this disclosure has moved to the first guiding position.
Figure 13C:
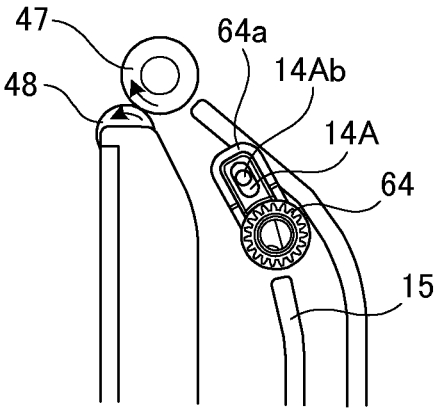
FIG. 13C is a side view illustrating a direction of rotation of the discharge inverting roller after the moving member according to the second embodiment of this disclosure has moved to the first guiding position.

First of all, an action to be taken by the drive mechanism 5A for discharging the sheet S will be described with reference to FIG. 12A to FIG. 13C. FIG. 12A is a side view illustrating the direction of rotation of the drive mechanism 5A when the moving member 14A according to the second embodiment of this disclosure pivots from the second guiding position to the first guiding position. FIG. 12B is a side view illustrating the direction of rotation of the planetary gear mechanism 80 in the state of FIG. 12A, and FIG. 12C is a side view illustrating the direction of rotation of the discharge inverting roller 47. FIG. 13A is a side view illustrating the direction of rotation of the drive mechanism 5A after the moving member 14A according to the second embodiment of this disclosure has moved to the first guiding position. FIG. 13B is a side view illustrating the direction of rotation of the planetary gear mechanism 80 in the state of FIG. 13A, and FIG. 13C is a side view illustrating the direction of rotation of the discharge inverting roller 47.

In a state of the moving member 14A being located at the second guiding position as illustrated in FIG. 12A, the controller 10A controls the solenoid 44 so that the input gear 60 rotates counterclockwise by an input of the drive force from the drive motor M. When the input gear 60 rotates counterclockwise, the revolving gear 61 in engagement with the input gear 60 rotates clockwise (first direction). When the revolving gear 61 rotates clockwise, the pair of revolving bosses 61*a* and 61*a* revolves clockwise about the center of rotation of the revolving gear 61 as an axis of revolution as illustrated in FIG. 12B.

Here, a portion where the internal tooth 63*a* and the planetary gear 62 engage is defined as an engaging portion O, and a portion where the sun gear 64 and the planetary gear 62 engage is defined as an engaging portion I. At the engaging portion O, a load FO proportional to a rotation torque of the discharge inverting roller 47 is applied to a tooth surface of the planetary gear 62 in a direction causing the planetary gear 62 to rotate counterclockwise. In contrast, at the engaging portion I, a load FI proportional to a torque for rotating the moving member 14A against its own weight is applied to the tooth surface of the planetary gear 62 in a direction of causing the planetary gear 62 to rotate counterclockwise. In other words, the load FO and the load FI work each other in directions of preventing the rotation of the planetary gear 62.

Therefore the sun gear 64 and the internal tooth 63*a* receive a force to rotate clockwise by a revolving force of the pair of planetary gears 62 and 62. Consequently, as illustrated in FIG. 12C, the sun gear 64 rotates clockwise, and the coupling portion 64*a* coupled to the sun gear 64 rotates clockwise. Then, the moving member 14A coupled to the coupling portion 64*a* pivots clockwise from the second guiding position to the first guiding position, and stops pivoting by abutting against the first stopper 49Aa. Accordingly, the sheet S can be guided to the discharge inverting nip N4 of the discharge inverting roller pair 46.

In the same manner, the internally-toothed gear 63 rotates clockwise and the discharge idler gear 66 configured to engage the external tooth 63*b* of the internally-toothed gear 63 rotates counterclockwise. The discharge inverting roller gear 65 in engagement with the discharge idler gear 66 rotates clockwise, so that the discharge inverting roller 47 rotates clockwise (normal rotation). Accordingly, the sheet S guided to the discharge inverting nip N4 of the discharge inverting roller pair 46 can be discharged to the discharge sheet stacking unit 7.

The rotation torque of the discharge inverting roller 47, the weight of the moving member 14A, and the numbers of teeth of the respective gears are set so that the load FO exceeds the load FI in order to prevent the sun gear 64 from being locked by the torque for pivoting the moving member 14A.

As illustrated in FIG. 13A, after the moving member 14A has positioned at the first guiding position by abutting against the first stopper 49Aa, the input gear 60 rotates counterclockwise, and the revolving gear 61 rotates clockwise. As illustrated in FIG. 13B, the pair of revolving bosses 61*a* and 61*a* rotates clockwise. In contrast, as illustrated in FIG. 13C, when the moving member 14A abuts against the first stopper 49Aa and stops at the first guiding position, the sun gear 64 is fixed.

Therefore, the pair of planetary gears 62 and 62 rotates clockwise about the revolving boss 61*a* while revolving clockwise along the outer peripheral portion of the sun gear 64 in association with the revolution of the pair of revolving bosses 61*a* and 61*a*. Consequently, the internally-toothed gear 63 rotates at an increased speed clockwise by the rotation of the pair of planetary gears 62 and 62, and the discharge inverting roller 47 rotates at an increased speed clockwise via the discharge idler gear 66. Accordingly, the sheet S guided to the discharge inverting nip N4 of the discharge inverting roller pair 46 can be discharged to the discharge sheet stacking unit 7. If the discharge inverting roller 41 rotates at an increased speed, the throughput is improved, and a tact time may be reduced. In other words, the productivity may be improved. Even though the sun gear 64 is fixed by the moving member 14A abutting against the first stopper 49Aa, the revolving gear 61, the planetary gears 62 and 62, and the internally-toothed gear 63 continue to rotate smoothly, so that the moving member 14A and the discharge inverting roller 47 can be smoothly driven.

Subsequently, the sheet inverting conveyance action by the drive mechanism 5A will be described with reference to FIG.

Figure 14A:
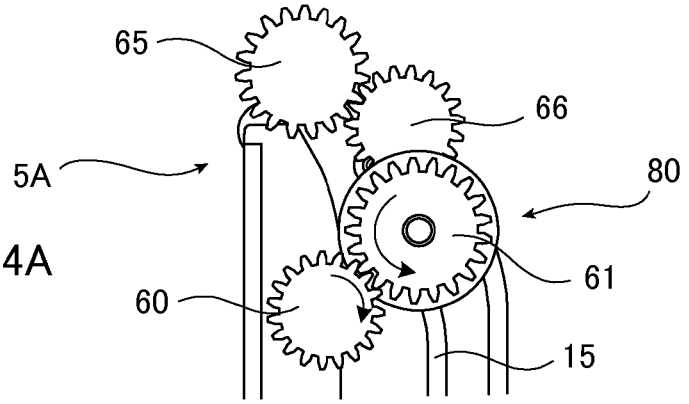
FIG. 14A is a side view illustrating a direction of rotation of the drive mechanism when the moving member according to the second embodiment of this disclosure pivots from the first guiding position to the second guiding position.
Figure 14B:
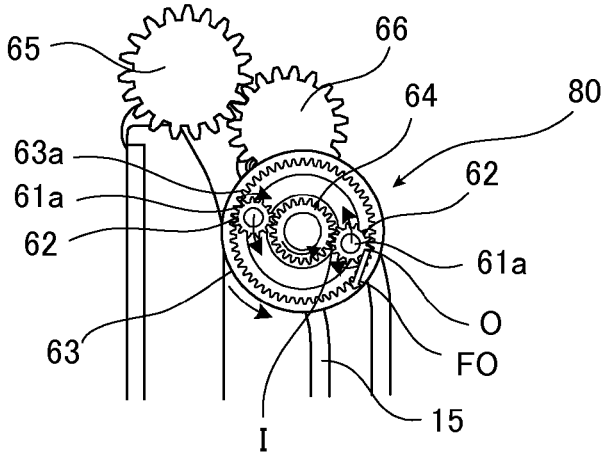
FIG. 14B is a side view illustrating a direction of rotation of the planetary gear mechanism when the moving member according to the second embodiment of this disclosure pivots from the first guiding position to the second guiding position.
Figure 14C:
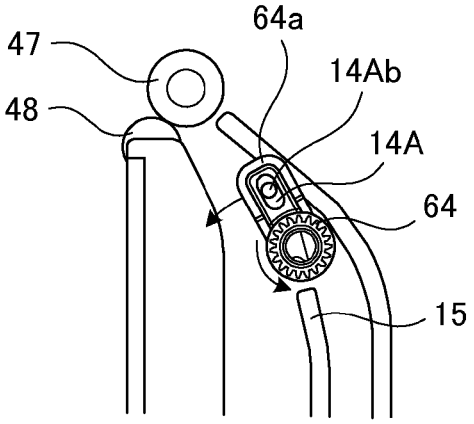
FIG. 14C is a side view illustrating a direction of rotation of the discharge inverting roller when the moving member according to the second embodiment of this disclosure pivots from the first guiding position to the second guiding position.
Figure 15A:
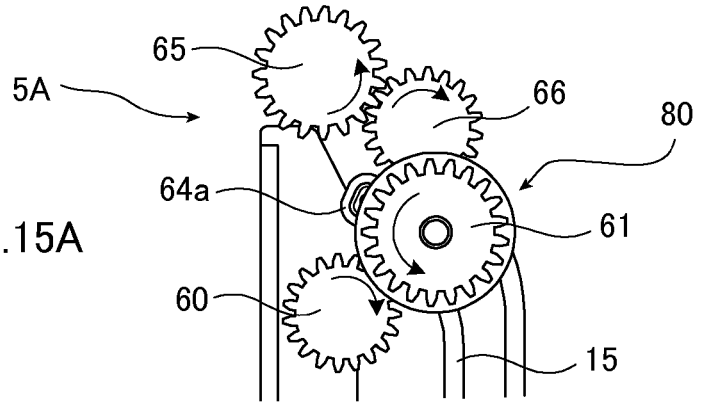
FIG. 15A is a side view illustrating a direction of rotation of the drive mechanism after the moving member according to the second embodiment of this disclosure has moved to the second guiding position.
Figure 15B:
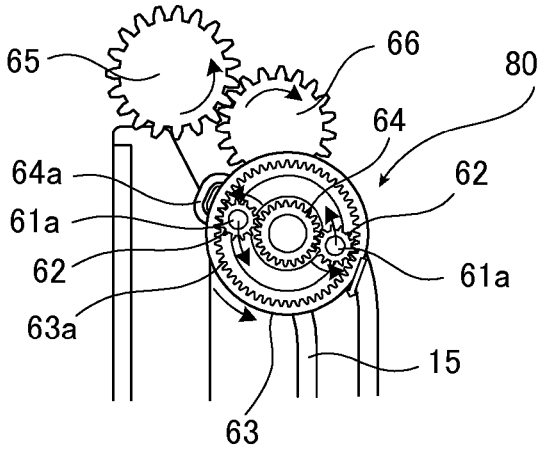
FIG. 15B is a side view illustrating a direction of rotation of the planetary gear mechanism after the moving member according to the second embodiment of this disclosure has moved to the second guiding position.
Figure 15C:
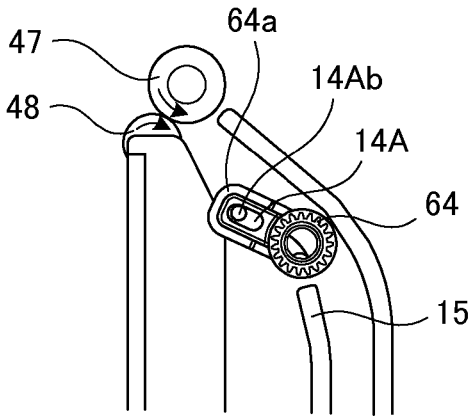
FIG. 15C is a side view illustrating a direction of rotation of the discharge inverting roller after the moving member according to the second embodiment of this disclosure has moved to the second guiding position.

14A to FIG. 15C. FIG. 14A is a side view illustrating a direction of rotation of the drive mechanism 5A when the moving member 14A according to the second embodiment of this disclosure pivots from the first guiding position to the second guiding position. FIG. 14B is a side view illustrating the direction of rotation of the planetary gear mechanism 80 in the state of FIG. 14A, and FIG. 14C is a side view illustrating the direction of rotation of the discharge inverting roller 47. FIG. 15A is a side view illustrating the direction of rotation of the drive mechanism 5A after the moving member 14A according to the second embodiment of this disclosure has moved to the second guiding position. FIG. 15B is a side view illustrating the direction of rotation of the planetary gear mechanism 80 in the state of FIG. 15A, and FIG. 15C is a side view illustrating the direction of rotation of the discharge inverting roller 47.

In a state of the moving member 14A being located at the first guiding position as illustrated in FIG. 14A, the controller 10A controls the solenoid 44 so that the input gear 60 rotates clockwise by an input of the drive force from the drive motor M. When the input gear 50 rotates clockwise, the revolving gear 61 in engagement with the input gear 60 rotates counterclockwise. When the revolving gear 61 rotates counterclockwise, the pair of revolving bosses 61*a* and 61*a* revolves counterclockwise about the center of rotation of the revolving gear 61 as an axis of revolution as illustrated in FIG. 14B.

At the engaging portion O, the load FO proportional to the rotation torque of the discharge inverting roller 47 is applied to the tooth surface of the planetary gear 62 in the direction causing the planetary gear 62 to rotate clockwise. In contrast, the moving member 14A is about to rotate in the direction of gravitational force under its own weight. At this time, the drive motor M is set to a predetermined speed so that the load is hardly applied to the tooth surface of the planetary gear 62 in the engaging portion I. In other words, the revolving speed of the planetary gear 62 and the rotational speed of the sun gear 64 clockwise under its own weight satisfy a predetermined relationship, and the load of the sun gear 64 is set to be next to zero.

Therefore, the pair of planetary gears 62 and 62 rotate clockwise while revolving counterclockwise along the inner peripheral portion of the internal tooth 63*a*. Since the load of the sun gear 64 is set to be next to zero, the rotational force is not transmitted to the internally-toothed gear 63. Consequently, as illustrated in FIG. 14C, the moving member 14A starts to rotate counterclockwise about the pivotal axis 14*a*, and stops when abutting against the second stopper 49Ab. While the moving member 14A pivots counterclockwise, the internally-toothed gear 63 does not rotate, and hence the drive force is not transmitted to the discharge inverting roller gear 65, and hence the discharge inverting roller 47 does not rotate.

As illustrated in FIG. 15A, after the moving member 14A has positioned at the second guiding position by abutting against the second stopper 49Ab, the input gear 60 rotates clockwise, and the revolving gear 61 continuously rotates counterclockwise (second direction). As illustrated in FIG. 15B, the pair of revolving bosses 61*a* and 61*a* rotates counterclockwise. In contrast, as illustrated in FIG. 15C, since the moving member 14A abuts against the second stopper 49Ab and stops at the second guiding position, the sun gear 64 is fixed.

Therefore, the pair of planetary gears 62 and 62 rotates counterclockwise about the revolving boss 61*a* while revolving counterclockwise along the outer peripheral portion of the sun gear 64 in association with the revolution of the pair of revolving bosses 61*a* and 61*a*. Consequently, the internally-toothed gear 63 rotates counterclockwise by the rotation of the pair of planetary gears 62 and 62, and the discharge inverting roller 47 rotates counterclockwise (reverse rotation) at an increased speed via the discharge idler gear 66. Accordingly, the sheet S is switched back and conveyed toward the duplex conveyance path 16.

As described above, in the second embodiment as well, the loss of the torque may be restrained without applying an excessive torque to the moving member 14A when the moving member 14A abuts against the first stopper 49Aa and the second stopper 49Ab in the same manner as the first embodiment. Consequently, the power consumption that operates the discharge inverting roller 47 and the moving member 14A may be reduced. Consequently, achievement of low power consumption in the entire printer 1A is possible.

In the second embodiment, the discharge inverting roller pair 46 is used instead of the discharge inverting 3-consecutive rollers 40 to constitute part of the discharge inverting unit 4A. Therefore, a reduction in size of the printer is enabled, and hence a cost reduction is achieved in comparison with the first embodiment.

By using the planetary gear mechanism 80, if the moving member 14A stops at the first and second guiding positions, the speed of the rotation of the discharge inverting roller 47 can be increased. Accordingly, improvement of the throughput is achieved, and the tact time may be reduced. Consequently, improvement of productivity is achieved.

When the moving member 14A pivots in the direction of gravitational force, the load of the sun gear 64 becomes substantially zero, and the internally-toothed gear 63 does not rotate. Therefore, energy (electric power) of the drive motor M for driving the discharge inverting roller 47 and the moving member 14A may be reduced.

Although the embodiments of this disclosure have been described thus far, this disclosure is not limited to the first and second embodiments. In addition, the effect which is described in the embodiments of this disclosure is simply the most suitable effect which can be obtained in the invention, and the effect of this disclosure is not limited to the descriptions in the embodiments of this disclosure.

For example, in the description of the first embodiment, the planetary gear 52 is employed as the first rotating element, the internally-toothed gear 53 is employed as the second rotating element, and the sun gear 54 is employed as the third rotating element. However, this disclosure is not limited thereto. The combination between the first rotating element to the third rotating element, and the planetary carrier (revolving gear 51), the outer gear (internally-toothed gear 53), and the sun gear 54 may be changed as needed.

In this embodiment, the drive forces input from the motor M configured to rotate in one direction to the input gears 50 and 60 are transmitted by being changed in direction of rotation by the solenoid 44. However, it is also possible to omit the solenoid 44 and rotate the drive motor M itself in the normal and reverse directions. Accordingly, the electric power for driving the solenoid 44 can further be saved by saving the power for driving the solenoid, so that a cost reduction is achieved.

In this embodiment, an electrophotographic image forming process has been exemplified as the image forming portion configured to form images on the sheet S. However, this disclosure is not limited thereto. For example, as the image forming portion configured to form an image on the sheet S, an ink jet image forming process configured to form images by discharging ink liquid from nozzles is also applicable.

In this embodiment, the discharge inverting units 4, 4A of the printers 1, 1A have been exemplified as the conveying device for switching the direction of conveyance of the sheets.

However, this disclosure is not limited thereto. For example, the conveying device may be used in other switchback mechanisms of the image forming apparatus, and may be used in the switchback mechanism such as an automatic document feeder (ADF) configured to feed documents automatically or a post-processing apparatus configured to perform the post-processing of the sheet.

In this embodiment, the moving member 14 is configured to pivot, however, this disclosure is not limited thereto. For example, the moving member 14 may be configured to slide by using a rack gear.

In this embodiment, the planetary gear mechanism 70 is configured to drive the moving member 14 which guides the sheet S and the conveying roller 47 which discharges the sheet S, however, this disclosure is not limited thereto. For example, the planetary gear mechanism may be configured to drive a feeding mechanism (such as lifting a stacking plate, moving feeding roller up and down, and rotating feeding roller) or an image forming mechanism (such as rotating a photoconductive drum and a developing roller).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-217105, filed Oct. 18, 2013 which is hereby incorporated by reference herein in its entirety.

What is claimed is:

1. A sheet conveying apparatus, comprising:

a conveying member rotating and conveying a sheet;

a moving member configured to be movable between a first guiding position and a second guiding position, the moving member guiding the sheet to a first conveyance path in the first guiding position and guiding the sheet to a second conveyance path in the second guiding position;

a first abutting portion configured to stop the moving member at the first guiding position by coming into abutment with the moving member having moved from the second guiding position to the first guiding position;

a second abutting portion configured to stop the moving member at the second guiding position by coming into abutment with the moving member having moved from the first guiding position to the second guiding position; and a planetary gear mechanism including:

a first rotating element configured to rotate in a first direction and a second direction which is opposite to the first direction;

a second rotating element configured to engage with the first rotating element and rotate the conveying member by drivenly rotating with the first rotating element, and a third rotating element configured to engage with the first rotating element, the third rotating element configured to move the moving member from the second guiding position to the first guiding position by drivenly rotating with the first rotating element rotating in the first direction, and move the moving member from the first guiding position to the second guiding position by drivenly rotating with the first rotating element rotating in the second direction.

2. The sheet conveying apparatus according to claim 1, wherein the first rotating element is a planetary gear, and the planetary gear mechanism includes a planetary carrier configured to rotate in the first direction and the second direction.

3. The sheet conveying apparatus according to claim 2, wherein the second rotating element is an internally-toothed gear configured to engage with the planetary gear, and the third rotating element is a sun gear configured to engage with the planetary gear.

4. The sheet conveying apparatus according to claim 3, wherein the conveying member rotates through the internally-toothed gear at an increased speed in response to regulation of the rotation of the sun gear by the moving member abutting with the first or second abutting portion.

5. The sheet conveying apparatus according to claim 3, wherein the planetary gear mechanism is configured such that a load applied between the internally-toothed gear and the planetary gear is larger than a load applied between the sun gear and the planetary gear when the moving member moves in a direction opposite from the direction of gravitational force.

6. The sheet conveying apparatus according to claim 3, wherein the planetary carrier rotates at a predetermined speed so that the drive force of the planetary carrier is not transmitted to the internally-toothed gear when the moving member pivots in the direction of gravitational force.

7. The sheet conveying apparatus according to claim 2, further comprising a drive source generating a driving power for rotating the planetary carrier.

8. The sheet conveying apparatus according to claim 7, further comprising:

an actuator configured to switch the direction of rotation of the drive force input to the planetary carrier from the drive source by switching a transmission route of the drive force.

9. The sheet conveying apparatus according to claim 1, wherein the second rotating element drivenly rotates with the first rotating element rotating in the first direction and the third rotating element is regulated to rotate drivenly with the first rotating element rotating in the first direction, in a state in which the moving member comes into abutment with the first abutting portion, and the second rotating element drivenly rotates with the first rotating element rotating in the second direction and the third rotating element is regulated to rotate drivenly with the first rotating element rotating in the second direction, in a state in which the moving member comes into abutment with the second abutting portion.

10. The sheet conveying apparatus according to claim 1, further comprising a connecting member connecting the third rotating element with the moving member.

11. The sheet conveying apparatus according to claim 1, wherein the conveying member includes a conveying roller configured to rotate forward and reverse.

12. The sheet conveying apparatus according to claim 11, wherein the conveying member includes a first roller rotating together with the conveying roller, and a second roller rotating together with the conveying roller, the second roller being arranged at an opposite side of the first roller across the conveying roller and the moving member guides the sheet toward a pair of the conveying roller and the first roller in the first guiding position, and guides the sheet toward a pair of the conveying roller and the second roller in the second guiding position.

13. The sheet conveying apparatus according to claim 12, wherein the first rotating element is rotated in the first direction to position the moving member at the first guiding position and to rotate the conveying roller in a normal direction in a case that the conveying roller and the first roller discharge the sheet out of the sheet conveying apparatus, and the first rotating element is rotated in the second direction to position the moving member at the second guiding position and to rotate the conveying roller in the reverse direction, and then the first rotating element is rotated in the first direction to position the moving member at the first guiding position and to rotate the conveying roller in the normal direction in a case that the conveying roller and the second roller invert and convey the sheet.

14. A sheet conveying apparatus, comprising:

a moving member configured to be movable between a first guiding position and a second guiding position, the moving member guiding the sheet to a first conveyance path in the first guiding position and guiding the sheet to a second conveyance path in the second guiding position;

a first abutting portion configured to stop the moving member at the first guiding position by coming into abutment with the moving member having moved from the second guiding position to the first guiding position;

a second abutting portion configured to stop the moving member at the second guiding position by coming into abutment with the moving member having moved from the first guiding position to the second guiding position; and a planetary gear mechanism including:

a first rotating element configured to rotate in a first direction and a second direction which is opposite to the first direction;

a second rotating element configured to engage with the first rotating element, and a third rotating element configured to engage with the first rotating element, the third rotating element configured to move the moving member from the second guiding position to the first guiding position by drivenly rotating with the first rotating element rotating in the first direction, and move the moving member from the first guiding position to the second guiding position by drivenly rotating with the first rotating element rotating in the second direction, wherein the second rotating element drivenly rotates with the first rotating element rotating in the first direction and the third rotating element is regulated to rotate drivenly with the first rotating element rotating in the first direction, in a state in which the moving member comes into abutment with the first abutting portion, and the second rotating element drivenly rotates with the first rotating element rotating in the second direction and the third rotating element is regulated to rotate drivenly with the first rotating element rotating in the second direction, in a state in which the moving member comes into abutment with the second abutting portion.

15. The sheet conveying apparatus according to claim 14, wherein the first rotating element is a planetary gear, and the planetary gear mechanism includes a planetary carrier configured to rotate in the first direction and the second direction.

16. The sheet conveying apparatus according to claim 15, wherein the second rotating element is an internally-toothed gear configured to engage with the planetary gear, and the third rotating element is a sun gear configured to engage with the planetary gear.

17. A drive transmission apparatus, comprising:

a rotating member configured to be rotatable;

a moving member configured to be movable between a first position and a second position;

a first abutting portion configured to stop the moving member at the first position by coming into abutment with the moving member having moved from the second position to the first position;

a second abutting portion configured to stop the moving member at the second position by coming into abutment with the moving member having moved from the first position to the second position; and a planetary gear mechanism including:

a first rotating element configured to rotate in a first direction and a second direction which is opposite to the first direction;

a second rotating element configured to engage with the first rotating element and rotate the rotating member by drivenly rotating with the first rotating element, and a third rotating element configured to engage with the first rotating element, the third rotating element configured to move the moving member from the second position to the first position by drivenly rotating with the first rotating element rotating in the first direction, and move the moving member from the first position to the second position by drivenly rotating with the first rotating element rotating in the second direction.

18. The sheet conveying apparatus according to claim 17, wherein the second rotating element drivenly rotates with the first rotating element rotating in the first direction and the third rotating element is regulated to rotate drivenly with the first rotating element rotating in the first direction, in a state in which the moving member comes into abutment with the first abutting portion, and the second rotating element drivenly rotates with the first rotating element rotating in the second direction and the third rotating element is regulated to rotate drivenly with the first rotating element rotating in the second direction, in a state in which the moving member comes into abutment with the second abutting portion.

19. An image forming apparatus comprising:

a conveying member rotating and conveying a sheet;

a moving member configured to be movable between a first guiding position and a second guiding position, the moving member guiding the sheet to a first conveyance path in the first guiding position and guiding the sheet to a second conveyance path in the second guiding position;

a first abutting portion configured to stop the moving member at a first guiding position by coming into abutment with the moving member having moved from the second guiding position to the first guiding position;

a second abutting portion configured to stop the moving member at a second guiding position by coming into abutment with the moving member having moved from the first guiding position to the second guiding position;

a planetary gear mechanism including:

a first rotating element configured to rotate in a first direction and a second direction which is opposite to the first direction;

a second rotating element configured to engage with the first rotating element and rotate the conveying member by drivenly rotating with the first rotating element, and a third rotating element configured to engage with the first rotating element, the third rotating element configured to move the moving member from the second guiding position to the first guiding position by drivenly rotating with the first rotating element rotating in the first direction, and move the moving member from the first guiding position to the second guiding position by drivenly rotating with the first rotating element rotating in the second direction;

an image forming portion configured to form an image on the sheet, and a controller controlling the direction of rotation of the first rotating element.

* * * * *